US012042841B2

(12) United States Patent
Farina et al.

(10) Patent No.: US 12,042,841 B2
(45) Date of Patent: Jul. 23, 2024

(54) METAL SHEET BENDING MACHINE

(71) Applicant: SALVAGNINI ITALIA S.P.A., Sarego (IT)

(72) Inventors: Giulio Farina, Sarego (IT); Roberto Meneghello, Sarego (IT)

(73) Assignee: SALVAGNINI ITALIA S.P.A., Sarego (IT)

( * ) Notice: Subject to any disclaimer, the term of this patent is extended or adjusted under 35 U.S.C. 154(b) by 349 days.

(21) Appl. No.: 17/608,218

(22) PCT Filed: May 7, 2020

(86) PCT No.: PCT/IB2020/054323
§ 371 (c)(1),
(2) Date: Nov. 2, 2021

(87) PCT Pub. No.: WO2020/225761
PCT Pub. Date: Nov. 12, 2020

(65) Prior Publication Data

US 2022/0314294 A1 Oct. 6, 2022

(30) Foreign Application Priority Data

May 8, 2019 (IT) ..... 102019000006656

(51) Int. Cl.
*B21D 5/02* (2006.01)

(52) U.S. Cl.
CPC ..... *B21D 5/0254* (2013.01); *B21D 5/0236* (2013.01)

(58) Field of Classification Search
CPC .. B21D 5/0236; B21D 5/0245; B21D 5/0254; B21D 5/02; B21D 37/04
See application file for complete search history.

(56) References Cited

U.S. PATENT DOCUMENTS 4,315,425 A 2/1982 Zbornik et al.
6,003,360 A 12/1999 Runk et al.
(Continued)

FOREIGN PATENT DOCUMENTS

CN 1978088 6/2007
CN 101085505 12/2007
(Continued)

OTHER PUBLICATIONS

Machine Translation of WO 2004/101188A1; 8 pages (Year: 2004).*
(Continued)

*Primary Examiner* — Debra M Sullivan
(74) *Attorney, Agent, or Firm* — WENDEROTH, LIND & PONACK. L.L.P.

(57) ABSTRACT

A bending machine for metal sheets includes a punch assembly having an upper tool-holding crosspiece that supports a set of upper bending tools with respective supporting pins and is provided with a guiding groove that is open for receiving the set of upper bending tools. The guiding groove has a lateral supporting groove that receives and supports the supporting pins and maintains the set of upper bending tools slidably coupled to the upper tool-holding crosspiece. The supporting groove has a single second lower opening to allow disengaging/engaging of the supporting pins from/with the supporting groove to remove/insert from/into the upper tool-holding crosspiece at the same time all the upper bending tools. The punch assembly has a single closing element connected to the upper tool-holding crosspiece that is linearly movable between closed and open positions to close and open the second lower opening.

15 Claims, 5 Drawing Sheets

(56) References Cited

U.S. PATENT DOCUMENTS

| | | | | |
|---|---|---|---|---|
| 7,094,579 | B2 | 8/2006 | Gray et al. | |
| 7,096,708 | B2 | 8/2006 | Gascoin | |
| 7,168,286 | B1 | 1/2007 | Pelech | |
| 7,343,774 | B2 | 3/2008 | Gascoin et al. | |
| 7,396,661 | B2 | 7/2008 | Gray et al. | |
| 7,972,811 | B2 | 7/2011 | Gray et al. | |
| 7,977,068 | B2 | 7/2011 | Gray et al. | |
| 8,099,992 | B2 | 1/2012 | Rouweler et al. | |
| 8,476,040 | B2 | 7/2013 | Gray et al. | |
| 10,300,518 | B2 | 5/2019 | Rogers | |
| 10,384,249 | B2 | 8/2019 | Denkmeier | |
| 10,500,623 | B2 | 12/2019 | Meneghetti | |
| 10,537,925 | B2 | 1/2020 | Klingesberger et al. | |
| 2007/0006635 | A1 | 1/2007 | Pabich | |
| 2017/0239701 | A1 | 8/2017 | Denkmeier | |
| 2018/0311720 | A1* | 11/2018 | Cavicchia | B21D 5/0254 |

FOREIGN PATENT DOCUMENTS

| | | | | |
|---|---|---|---|---|
| CN | 207387850 | | 5/2018 | |
| CN | 207508304 | | 6/2018 | |
| EP | 1 529 571 | | 5/2005 | |
| FR | 2 598 946 | | 11/1987 | |
| JP | 2005-074429 | | 3/2005 | |
| JP | 2015-517407 | | 6/2015 | |
| JP | 2018-515346 | | 6/2018 | |
| RU | 2 325 242 | | 5/2008 | |
| RU | 2 338 613 | | 11/2008 | |
| RU | 2 662 510 | | 7/2018 | |
| RU | 2 663 018 | | 8/2018 | |
| WO | WO-2004101188 | A1 * | 11/2004 | B21D 5/0209 |
| WO | 2013/166538 | | 11/2013 | |
| WO | 2016/054668 | | 4/2016 | |

OTHER PUBLICATIONS

International Search Report issued Sep. 14, 2020 in International (PCT) Application No. PCT/IB2020/054323.

Notice of Reasons for Refusal issued Jan. 17, 2023 in corresponding Japanese Patent Application No. 2021-565906, with English-language translation.

Office Action issued May 20, 2023 in corresponding Russian Patent Application No. 2021133978, with English-language Search Report.

Office Action issued Mar. 23, 2023 in corresponding Chinese Patent Application No. 202080033116.9, with English-language Search Report.

* cited by examiner

METAL SHEET BENDING MACHINE

The invention relates to bending machines arranged to bend and shape metal strips, sheets, profiles so as to obtain semi-finished and/or finished products. In particular, the invention relates to a bending machine provided with a system for replacing bending tools. Bending machines, also called bending presses, are known that include a mechanically or hydraulically operated press capable of moving an upper tool, so called punch, to abut a lower tool, so called a die, on which a workpiece is positioned. The punch exerts a force on the piece that can deform and bend the latter according to an angle determined by the configuration of the upper and lower tools.

A type of bending machines comprises a punch formed by a bending blade or edge capable of deforming along a predefined folding line the metal piece that is suitably positioned on an opposite die provided with a longitudinal seat or groove adapted to interact with the punch so as to bend the piece.

Generally, the punch is formed by a set of upper bending tools or segments that are slidably mounted on an upper, vertically movable tool-holding crosspiece or table so as to form a modular punch. In fact, number, size (width) and position of the upper tools are selected according to the length of the bending to be made and/or the dimensions of the workpiece, while the type of tools is chosen according to the type of bending (angle, shape).

Similarly, the die may be formed by a set of lower bending tools or segments that are mounted on a lower, generally fixed, tool-holding crosspiece or table so as to form a modular die. Number, size (width) and position of the lower tools correspond respectively to number, size and position of the upper tools so as to realize a bending of definite length.

To perform a bending of definite length on the workpiece, it is necessary to choose in the sets of tools mounted on the upper and lower crosspieces, adjacent tools with sizes (width) that allow to obtain exactly the required length and then arrange and position the tools suitably at the workpiece by sliding the tools along the respective crosspieces.

However, since the dimensions of the tool are standardized and variable in discrete way (typically with 10 mm pitch) according to predefined sizes (widths), it is not always possible to make the required bends with the sets of tools currently mounted on the crosspieces. In order to perform successive and different machining cycles, it is therefore often necessary to replace, at least partially, the bending tools mounted on the crosspieces.

For this purpose, the known bending machines are generally provided with a tool magazine and an automatic tool replacement systems which include gripping and transfer means capable of mounting the tools taken from the magazine in the desired positions on the tool-holding crosspieces and disassembling the tools to be replaced and inserted into the magazine from the tool-holding crosspieces.

The tool magazine typically comprises a plurality of supports or guides adapted to house sets or groups of tools having different sizes and shapes.

The tool magazine can be external, positioned outside the bending machine, typically at one side thereof, adjacent to a lateral upright of the machine, or internal, positioned inside the machine, in the compartment or volume between the two lateral uprights of the bending machine.

In the case of internal magazine, the latter generally comprises a plurality of tool holders that are generally fixed to the inner walls of the upper tool-holding crosspiece and/or the lower tool-holding crosspiece or the lateral uprights and the replacement systems comprise gripping and transfer means, such as manipulators or articulated mechanisms, capable of inserting or removing the tools into or from the crosspieces and moving the tools along the crosspiece to make the required tool compositions.

In order to enable the tools to slide longitudinally, and thus to be positioned and/or grouped on the tool-holding crosspieces, the latter one include respective longitudinal guiding grooves within which the connecting ends of the bending tools, opposite the operating ends that interact with the workpiece, can be inserted vertically.

In order to secure the upper bending tools to the upper crosspieces and prevent upper bending tools from detaching vertically due to gravity, the upper bending tools are provided with respective supporting pins, that are transverse and laterally protruding, intended to slidably engage a lateral supporting groove made on a side or inner side wall of the guiding groove. More precisely, the connecting end of each bending tool has at least one protruding transverse pin (arranged horizontally and substantially orthogonal to a longitudinal sliding direction of the tools along the crosspiece), which engages said supporting groove. In this way, the upper bending tools can slide along the tool-holding crosspiece.

Locking systems are provided on the tool-holding crosspieces and can be selectively activated to firmly lock the bending tools to the crosspieces, inside the guiding grooves, so as to prevent any movement of the bending tools during machine operation, both to ensure the quality of the bending operation and the operator safety.

In order to allow replacement of the tool, i.e. its removal from, or insertion into, the guiding groove, the transverse pin is movable, i.e. it can be retracted inside the tool body or extended outside, so as to disengage from or engage the lateral supporting groove. Retraction or unlocking movement of the transverse pin from the supporting groove is carried out by means of suitable mechanisms provided within the tool and operable manually by an operator or automatically by gripping means of the tool replacement systems in the machine. Elastic elements are arranged inside the tool to move back and maintain, in absence of external actions, the transverse pin in the extended engaging or locking position into the lateral supporting groove.

Numerous and different more or less complex solutions have been developed in order to enable the transverse pin to be unlocked/locked and thus to insert or remove the bending tool into or from the upper tool-holding crosspiece.

These solutions are generally quite complex and therefore expensive to be implemented and in any case may incur to malfunctions due to the mechanical stresses to which the moving/unlocking mechanisms of the transverse pin are subjected during the use of the tools in bending processes.

Moreover, the same bending tools, having more or less extended inner cavities or chambers for housing the aforementioned mechanisms, have a significantly lower structural resistance to mechanical stresses than traditional tools without such mechanisms.

Finally, the known tool replacement systems allow replacement of one bending tool at a time, which is why the assembly and/or disassembly operations of a set or group of tools (which must be picked up and/or stored in the magazine) require a long period of time during which the bending machine must be stopped, thus interrupting its production and consequently decreasing its productivity.

Document JP 2005074429 discloses a system for engaging/disengaging upper and lower bending tools to/from upper and lower tool-holding crosspieces of a bending machine. The tool-holding crosspieces include respective longitudinal grooves arranged to slidably receive the bending tools. Each longitudinal groove comprises a longitudinal side recess adapted to receive a supporting tooth of a respective bending tool to keep the latter coupled to the tool-holding crosspiece, preventing it from disengaging along a vertical direction. The longitudinal side recess has a plurality of regularly spaced openings that allow disengagement of the supporting tooth to remove/insert the respective bending tool from/into the tool-holding crosspiece. The openings of the longitudinal lateral recess are selectively closed or opened by respective fastening members. The fastening members are rotatably connected to the tool-holding crosspiece, rotatable between a closed position and an open position. In the closed position, each fastening member closes the respective opening of the longitudinal lateral recess to keep the supporting tooth engaged in the longitudinal lateral recess and the upper bending tool coupled to the tool-holding crosspiece. In the open position, each fastening member is rotated so as not to close the respective opening to allow disengagement of the supporting tooth and removal/insertion of the upper bending tool. The fastening members are manually operated by an operator in the open position by pushing on suitable pressure portions and allow to manually remove/insert one bending tool at a time. Therefore, assembly and/or disassembly operations of a group or set of tools in addition to not being automated, require the direct intervention of one or more operators, and consequently a long period of time during which the bending machine must be stopped, interrupting its production.

An object of the present invention is to improve the known bending machines provided with modular punches and dies, i.e. formed by a set of bending tools slidably mounted on tool-holding crosspieces, and equipped with a tool magazine and bending tool replacement systems.

Another object is to obtain a bending machine that allows to replace the bending tools, in particular the upper bending tools, in an automatic, fast, simple and precise manner, minimizing the stopping times of the bending machine.

A further object is to provide a bending machine having a simple and compact structure, with effective and reliable functioning.

These and other objects are achieved by a bending machine according to any one of the claims set forth below.

The invention can be better understood and implemented with reference to the attached drawings which illustrate an exemplifying and non-limiting embodiment thereof, wherein.

Figure 1:
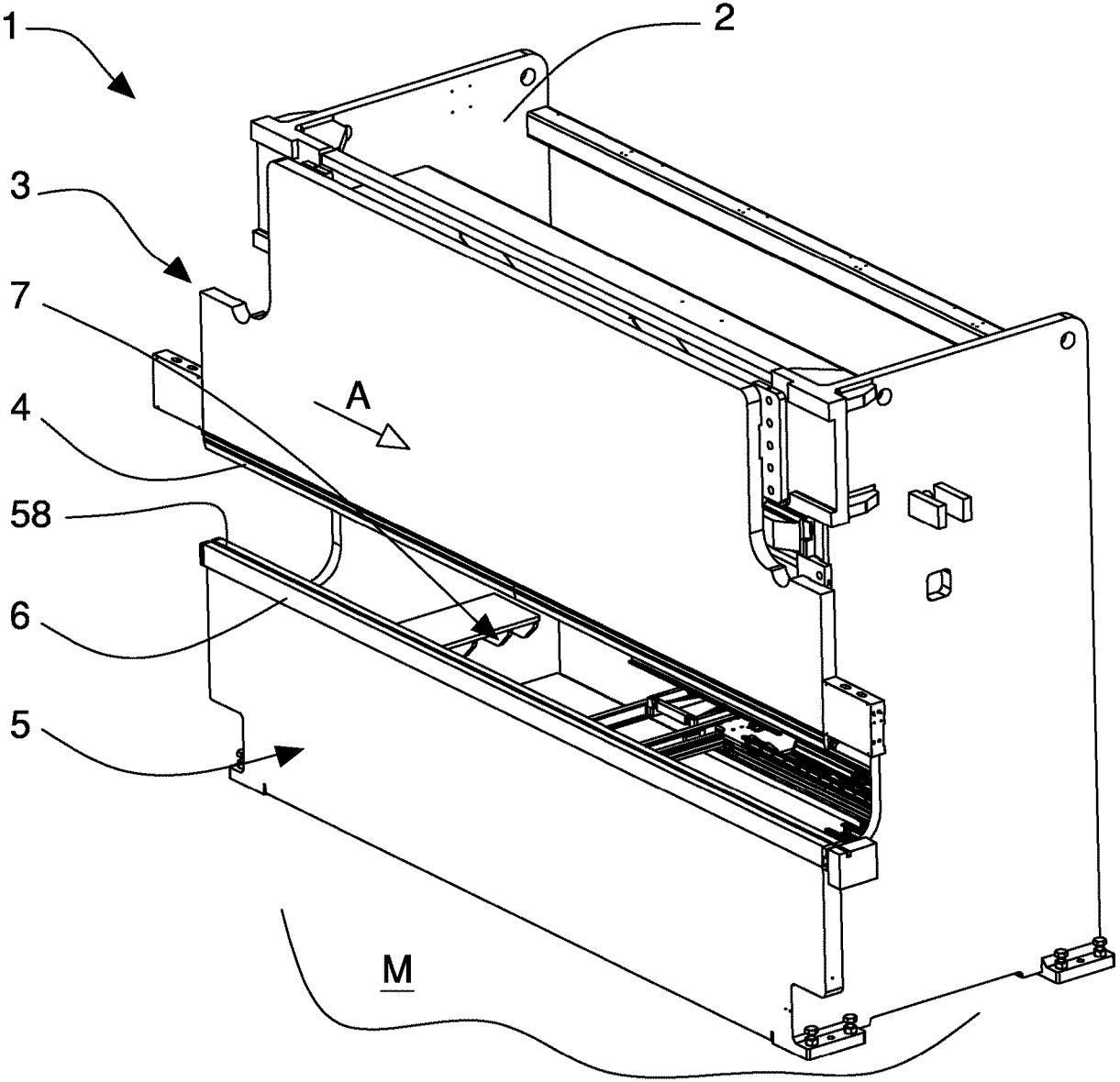
FIG. 1 is a schematic perspective front view of the bending machine of the invention.

With reference to FIGS. 1 to 8, the bending machine 1 for metal sheets according to the invention is shown that comprises a supporting frame 2 to which punch means 3 and die means 5 are connected.

The supporting frame 2, the punch means 3 and the die means 5 define an inner compartment 7 of the bending machine 1.

The punch means 3 substantially comprises an upper table and are slidably connected to the supporting frame 2 so as to be movable by actuating means, known and not illustrated, along a working direction orthogonal to a supporting plane M of the bending machine 1, namely along a substantial vertical direction.

The bending machine 1 comprises at least one set 60 of upper bending tools 61, particularly in a operating step. More precisely, punch means 3 includes an upper tool-holding crosspiece 4 provided with, and supporting, at least one set 60 of upper bending tools 61 having respective supporting pins 65 and aligned and reciprocally positionable on said upper tool-holding crosspiece 4 along a bending direction A, that is in particular longitudinal and parallel to the supporting plane M.

The upper tool-holding crosspiece 4 is provided with a guiding groove 14, opened at the bottom by a first lower opening 14*c* facing the supporting plane M, and adapted to slidably receive the set 60 of upper bending tools 61. The guiding groove 14 is parallel to the bending direction A.

Punch means 3 comprises locking means 40 that are associated with the upper tool-holding crosspiece 4 and are selectively activable to firmly lock the upper bending tools 61 to the upper tool-holding crosspiece in order to prevent any displacement, in particular transverse to, and longitudinal along, the bending direction A of said upper bending tools 61 during the operation of the bending machine 1, so as to ensure both the quality and accuracy of the bending operation of the workpiece and safety of the operator that uses the bending machine. The set 60 of upper bending tools 61 includes a predefined number of upper bending tools 61 that allow performing, suitably arranging the latter one, a plurality of different operations on the workpieces. The set 60 of upper bending tools 61 is interchangeable, i.e. replaceable with one of a plurality of different sets of upper bending tools 61, in particular housed in a tool magazine 10 provided in the inner compartment 7 of the bending machine 1.

In particular, in a working configuration of the bending machine 1, the upper tool-holding crosspiece 4 of punch means 3 is provided with and supports a plurality of sets 60 of upper bending tools 61, for example three and interchangeable too, which form a complete arrangement of bending tools that allows specific bends (having definite shape, angle and bending geometry) to be made on the piece with lengths that vary continuously with a defined pitch starting from a minimum value. In fact, the tools are reciprocally positionable along the bending direction A so as to form definite tool compositions.

The guiding groove 14 extends over the entire length of the upper tool-holding crosspiece 4 and includes a lateral supporting groove 24 arranged to receive and support the supporting pin 65 of each upper bending tool 61 so as to keep the latter slidably connected to the upper tool-holding crosspiece 4 in an assembly configuration W and prevent disengagement of the upper bending tool, in particular along an extraction direction V substantially orthogonal to the supporting plane M. More precisely, the supporting groove 14 receives all the supporting pins 65 of the set 60 of upper bending tools 61 mounted on the upper tool-holding crosspiece 4.

The supporting groove 24 further has a single second lower opening 24*a*, in particular facing the supporting plane M, which allows to disengage/engage, along the extraction direction V, the supporting pins 65 of the respective upper bending tools 61 from/with the supporting groove 24 in order to remove/insert the upper bending tools 61 from/into the upper tool-holding crosspiece 4. More precisely, the second lower opening 24*a* of the supporting groove 24 has a definite length L along the bending direction A such as to allow to disengage/engage the supporting pins 65 of all the upper bending tools 61 of the set 60 and thus allow to remove/insert simultaneously all the upper bending tools 61 of the set 60 from/into the upper tool-holding crosspiece 4. The definite length L is longer than or substantially equal to a length of the set 60 of upper bending tools 61, for example is between 900 and 1100 mm, in particular is equal to 1020 mm. The second lower opening 24*a* is preferably positioned in the centre of the upper tool-holding crosspiece 4.

The punch means 3 further comprises a single closing element 13 connected to the upper tool-holding crosspiece 4 and movable between a closed position C and an open position D. In the closed position C the closing element 13 closes the second lower opening 24*a* of the supporting groove 24 so as to keep the supporting pins 65 engaged and within the aforementioned supporting groove 24 and thus the upper bending tools 61 slidably connected to the upper tool-holding crosspiece 4 in the mounting configuration W. In the open position D, the closing element 13 is spaced from, and does not close, the second lower opening 24*a* to allow disengagement of the supporting pins 65 along the removal direction V and thus of the respective upper bending tools 61 from the upper tool-holding crosspiece 4.

In particular, the closing element 13 is connected to the upper tool-holding crosspiece 4 so as to be movable between the closed position C and the open position D linearly, along an opening direction T substantially parallel to the supporting plane M.

The closing element 13 has substantially the same definite length L of the lower opening 24*a* so as to allow to remove from and/or insert into the upper tool-holding crosspiece 4 at the same time all the upper bending tools 61 of the set 60 of upper bending tools 61. First actuating means are provided to move the closing element 13 along the opening direction T in both directions of motion.

In particular, the first actuating means comprise a first elastic conduit 23, e.g. a flexible hose made of elastomeric material, fed with pressurized fluid, e.g. oil. The first elastic conduit 23 is inserted into a suitable longitudinal seat 13*a* of the closing element 13 and is interposed between the latter and an internal or rear wall 4*a* of the upper tool-holding crosspiece 4. When pressurized oil flows through the first elastic conduit 23 the latter expands causing the movement of the closing element 13 from the closed position C to the open position D. The length or stroke of this movement is small and ranges, for example, from 2 to 5 mm, in particular is 3 mm.

The first actuating means further comprises first elastic means acting on the closing element 13 so as to return the latter from the open position D to the closed position C when the elastic conduit 23 is no longer fed with pressurized oil. The first elastic means comprises, for example, a plurality of compression springs, of known type and not illustrated in the figures, that are interposed between an external wall 13*b* of the closing element 5 and a fastening plate 44 fastened to the internal wall 4*a* of the upper tool-holding crosspiece 4.

Alternatively, first actuating means may comprise one or more linear actuators, of a known type, for example pneumatic, hydraulic, electrical actuators, connected to the upper tool-holding crosspiece 4 and capable of moving the closing element 13 along the opening direction T between the open position D and the closed position C.

Each upper bending tool 61 comprises an upper connecting end 61*a*, which can be inserted into the guiding groove 14 via the first lower opening 14*c*, and an opposite lower operating end 61*b* adapted to interact with a workpiece. The supporting pin 65 is fixed transversely to the connecting end 61*a* so as to protrude therefrom, is arranged substantially parallel to the supporting plane M and is orthogonal to the bending direction A. The supporting pin 65 preferably has cylindrical shape in order to facilitate sliding of the corresponding upper bending tool 61 inside the guiding groove 14 along the bending direction A.

It is also possible that the supporting pin 65 is rotatably fixed to the upper bending tool 61 so as to be free to rotate about a respective longitudinal axis, in order to further facilitate sliding of the upper bending tool 61 into the guiding groove 14.

The guiding groove 14 comprises a first bottom wall 14*a* opposite and facing the first lower opening 14*c* and substantially parallel to the supporting plane M and a pair of first lateral walls 14*b* facing each other, parallel and substantially orthogonal to the first bottom wall 14*a*. The supporting groove 24 is made in one of the first side walls 14*b* and in particular in the one closest to the internal wall 4*a* of the upper tool-holding crosspiece 4.

The supporting groove 24 extends laterally over the entire length of the guiding groove 14 and includes a second bottom wall 24*b* substantially orthogonal to the supporting plane M and a pair of second side walls 24*c* facing each other, parallel and substantially orthogonal to the second bottom wall 24*b*. The second lower opening 24*a* of the supporting groove 24 is made on the second side wall 24*c* arranged for abutting and supporting the supporting pins 65, i.e. the lower second side wall 24*c*.

In the illustrated embodiment, the second bottom wall 24*b* of the supporting groove 24 is formed by a longitudinal abutment element 43 fixed to the upper tool-holding crosspiece 4 and extending along the entire length of the second lower opening 24*a* of the supporting groove 24. The longitudinal abutment element 43 supports and slidably guides the closing element 13 along the opening direction T.

The locking means 40 comprises, for example, a plurality of movable locking elements 41, which are housed in the upper tool-holding crosspiece 4, in particular regularly spaced thereon along the bending direction A, and configured to engage and lock the upper bending tools 61 of the set 60 in a locking configuration G so as to prevent any movement of said upper bending tools. More precisely, the locking elements 41, which are housed in respective seats of the upper tool-holding crosspiece 4, are driven linearly, in particular parallel to the opening direction T, by second actuating means 25, 26 between the locking configuration G and a releasing configuration H, in which said locking elements do not engage and lock the upper bending tools 61, in particular they do not abut and engage locking recesses 66 of the upper bending tools.

Each locking member 41 has a substantially "T" shape according to a cross section (i.e. orthogonal to the bending direction A and the supporting plane M), and comprises a first portion 45 parallel to the opening direction T, a second portion 46 substantially perpendicular to the first portion 45 and having a free end that is shaped and adapted to engage a locking recess 66 of an upper bending tool 66 in the locking configuration G, and a third portion 47 substantially perpendicular to the first portion 45 and parallel to the second portion 46 and arranged to be abutted by the second actuating means.

The second portion 46 comprises at the free end a locking tooth 46*a* having a shape that is complementary to the shape of the locking recess 66.

The second actuating means comprises a second elastic conduit 25, e.g. a flexible hose made of elastomeric material, fed with pressurized fluid, e.g. oil. The second elastic conduit 25 is inserted into a suitable longitudinal seat 17 of the upper tool-holding crosspiece 4. The first elastic conduit 23 expands when is fed with pressured oil, t causing displacement of all the locking elements 41 from the releasing position H to the locking position G.

The second actuating means further comprises second elastic means 26 acting on the locking elements 41 so as to return the latter one from the locking position G to the releasing position H when the second elastic conduit 25 is no longer fed with pressurized oil. The second elastic means comprises, for example, a plurality of compression springs 26, each acting on the first portion 45 of the respective locking element 41.

The locking recess 66 of each upper bending tool 61 is made on the connecting end 61*a*, above the supporting pin 65.

The die means 5, arranged to interact with the punch means 3 to perform machining on a workpiece, substantially comprises a lower table that is provided in the illustrated embodiment with a lower tool-holding crosspiece 6 adapted to support a plurality of lower bending tools 51, aligned and positionable along the bending direction A. In particular, the lower tool-holding crosspiece 6 is provided with a further guiding groove 58, open at the top, adapted to slidably house a plurality of lower bending tools 51 that form, for example, a set 50 of lower bending tools 51 to perform in cooperation with the set 60 of upper bending tools 61 a plurality of different operations on the workpieces.

The set 50 of lower bending tools 51 is interchangeable with one of a plurality of different sets of lower bending tools, in particular housed in the tool magazine 10 of the bending machine 1

In particular, in a working configuration of the bending machine 1, the lower tool-holding crosspiece 6 of the die means 5 supports a plurality of sets 50 of lower bending tools 51, for example three, which are reciprocally positionable along the bending direction A so as to form definite compositions of bending tools to perform respective machining on the pieces. The bending machine 1 of the invention further comprises gripping means 21, 22 arranged for simultaneously clasping and moving all the upper bending tools 61 of the set 60 of upper bending tools 61, and in particular for removing/inserting from/into the guiding groove 14 said set 60 of upper bending tools 61 along the removal/insertion direction V. The gripping means 21, 22 are also arranged for simultaneously moving a set 50 of lower bending tools 51, and in particular for removing or inserting from/into the further guiding groove 58 all the lower bending tools 51 of the set 50 along the removal/insertion direction V.

The gripping means comprise a pair of gripping elements 21, 22 movable and arranged to engage and lock in a first gripping position P1 the clasping seats 62 of all upper bending tools 61 of the set 60 of upper bending tools 61 or the corresponding clasping seats 52 of all lower bending tools 51 of the set 50 of lower bending tools.

In the illustrated embodiment, the clasping seat 62 of the respective upper bending tool 61 comprises a corresponding shaped cavity made on a connection element 63 fixed to the inner side (i.e. facing the inner compartment 7) of the tool.

Figure 2:
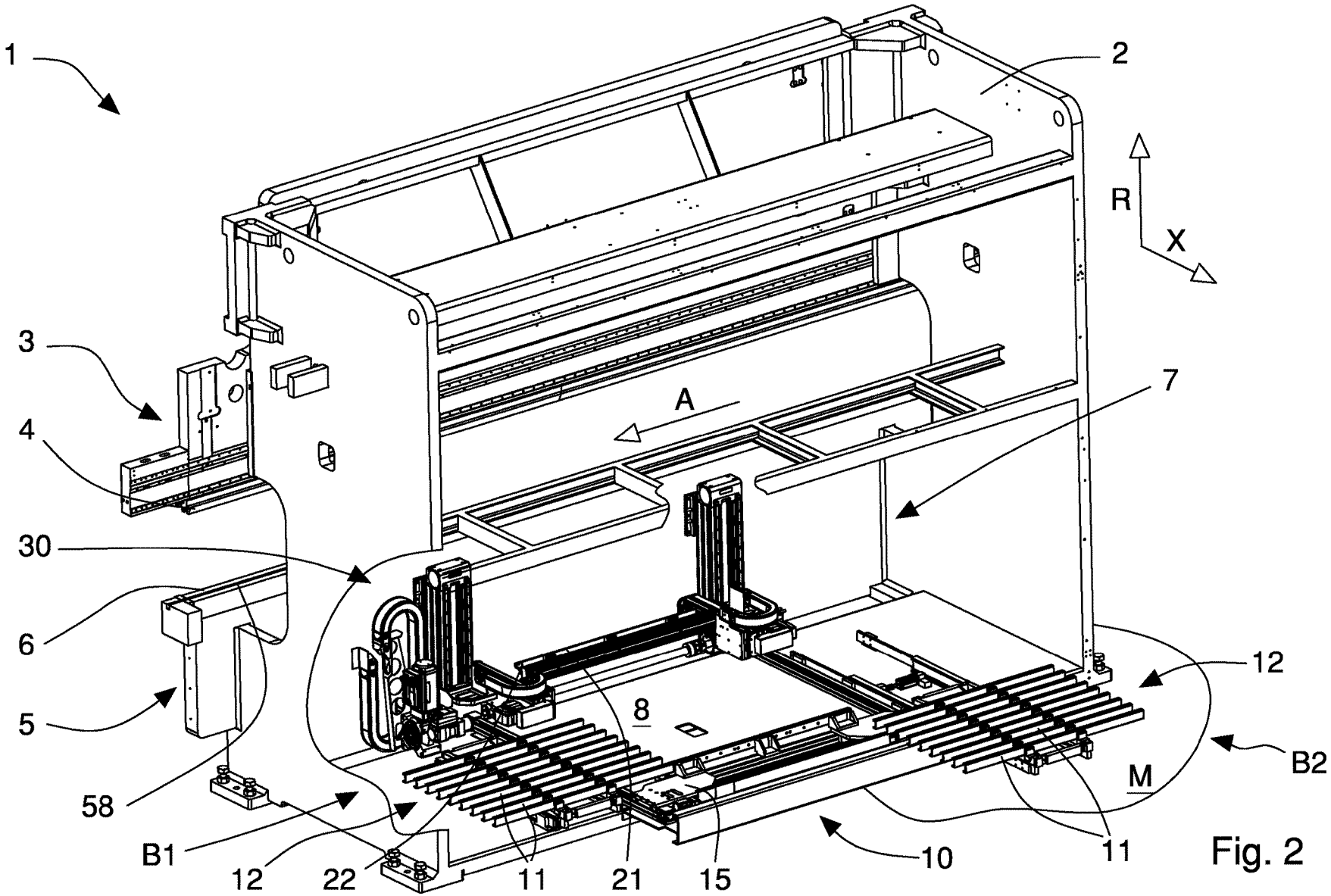
FIG. 2 is a partial rear perspective view of the bending machine of FIG. 1 illustrating in particular a tool magazine and a bending tool replacement apparatus.
Figure 4:
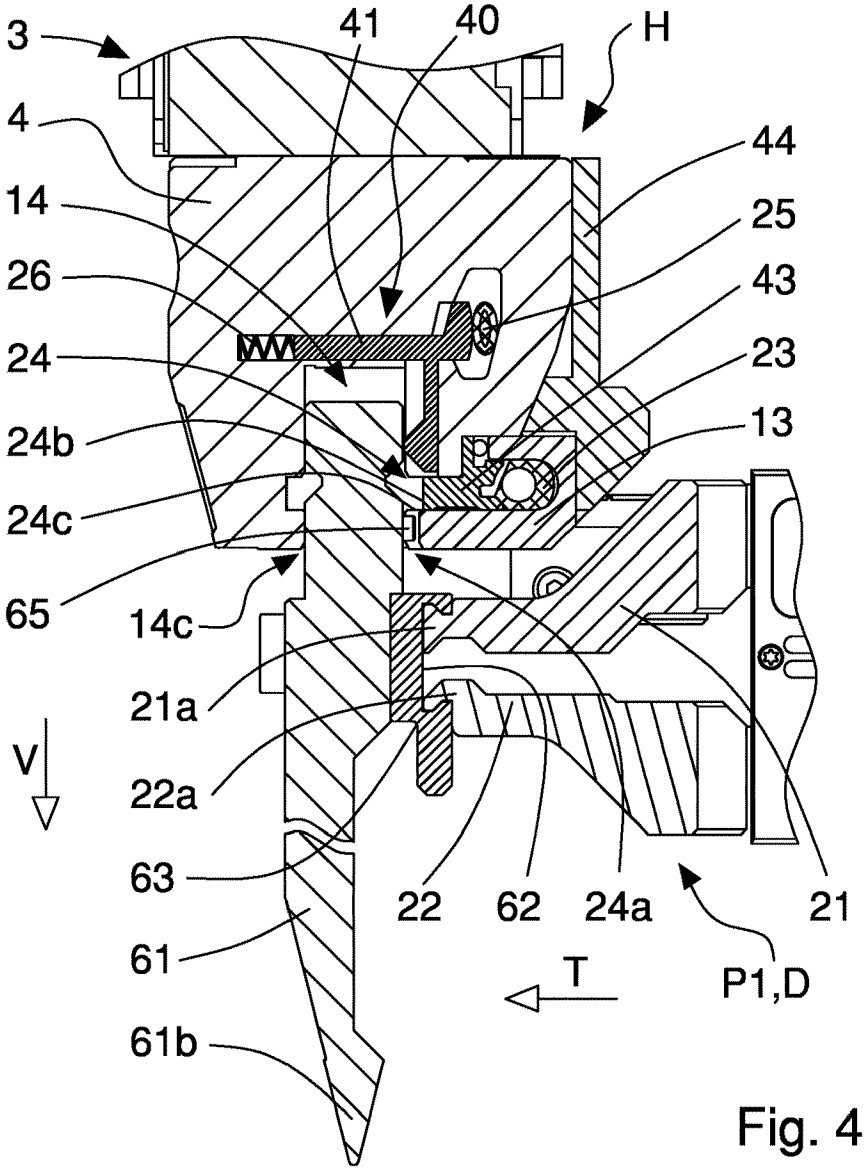
FIG. 4 is a section view similar to that of FIG. 3 wherein the upper bending tool is disengaged and partially removed from the upper tool-holding crosspiece by the gripping means.
Figure 3:
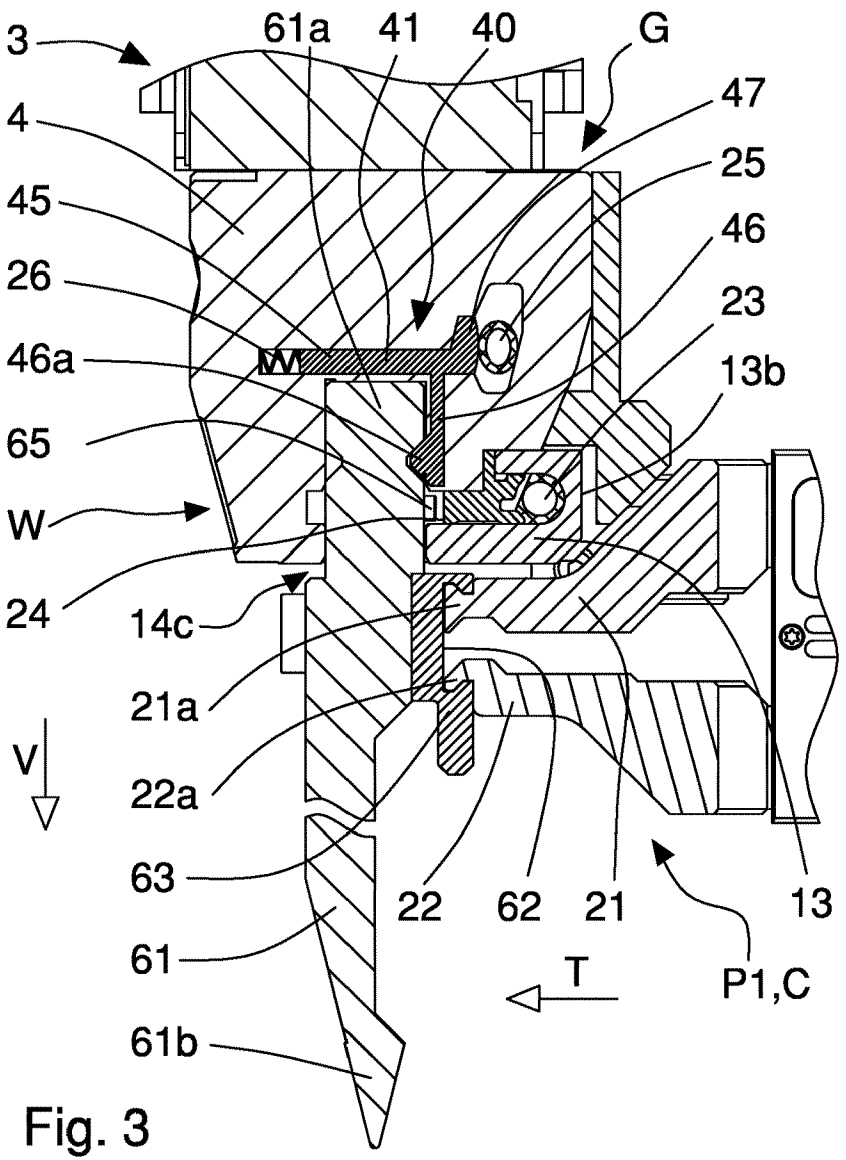
FIG. 3 is an enlarged partial cross section view of an upper tool-holding crosspiece of punch means supporting an upper bending tool in an assembled configuration and clasped by gripping means of the replacement apparatus.
Figure 5:
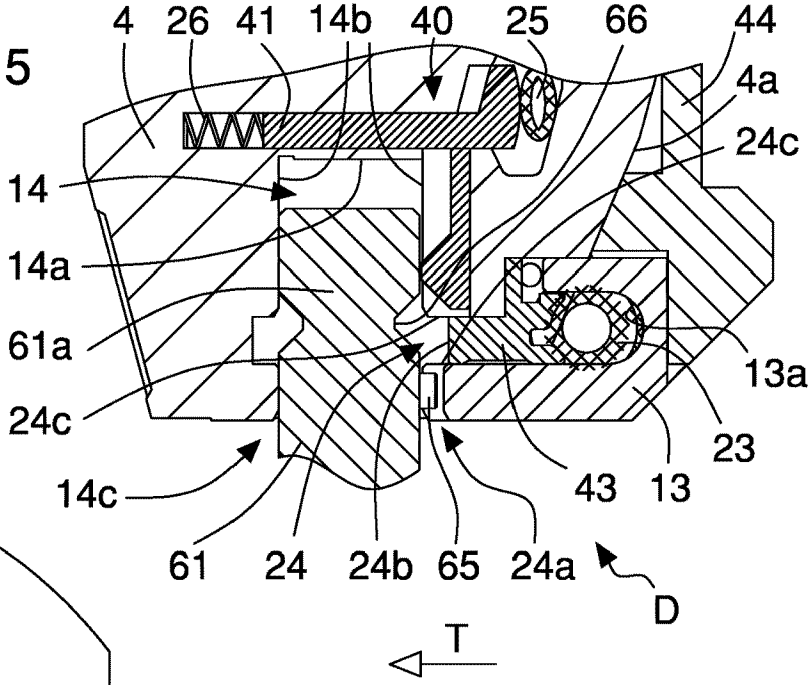
FIG. 5 is an enlarged detail of the section view of FIG. 4.
Figure 6:
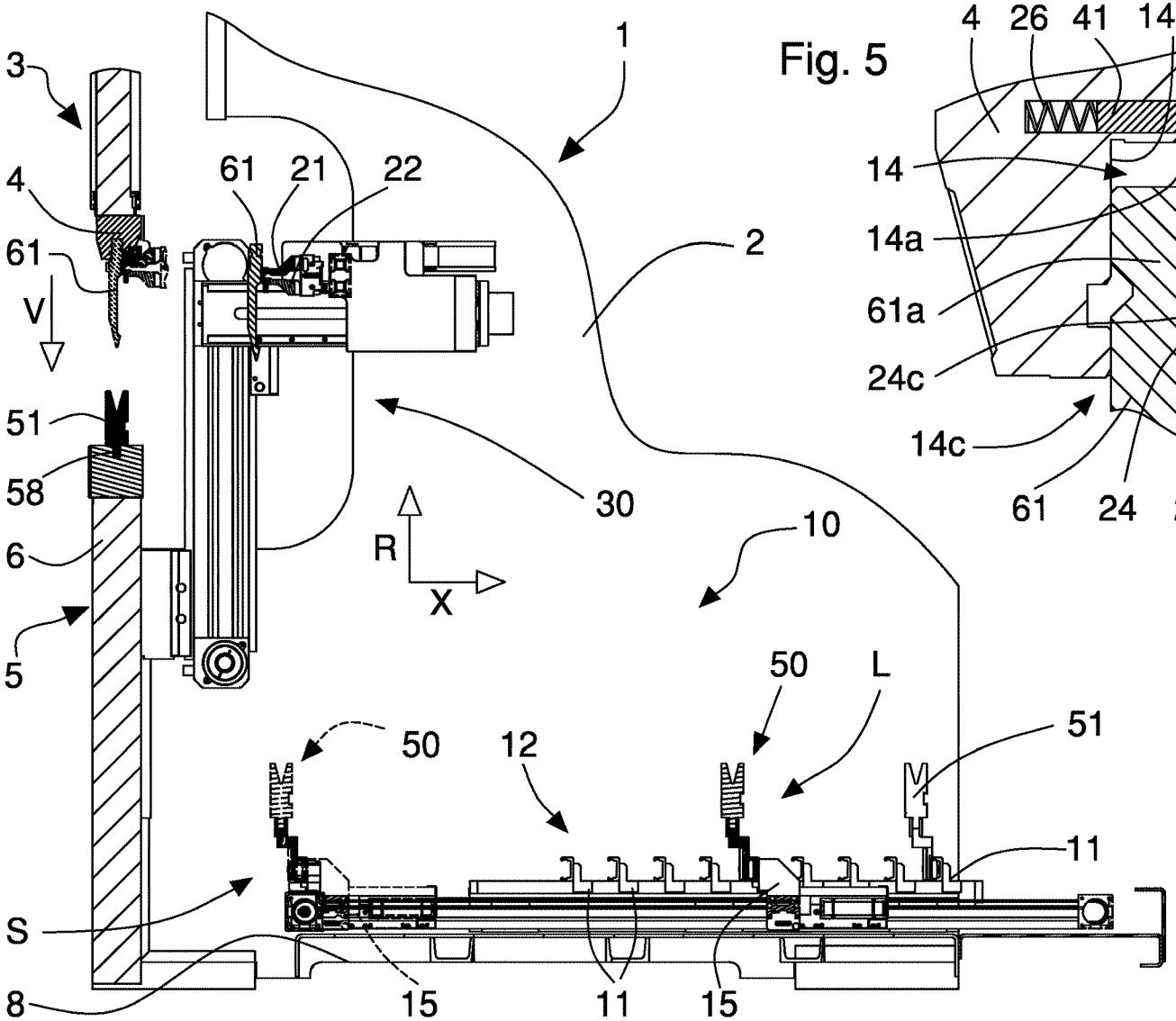
FIG. 6 is a cross section view of the bending machine of FIG. 1 illustrating, with a dashed line, the upper bending tool fixed to the upper tool-holding crosspiece in the assembly configuration, clasped by gripping means, and the same upper bending tool removed from the upper tool-holding crosspiece by the gripping means in a disassembly and replacement step.
Figure 8:
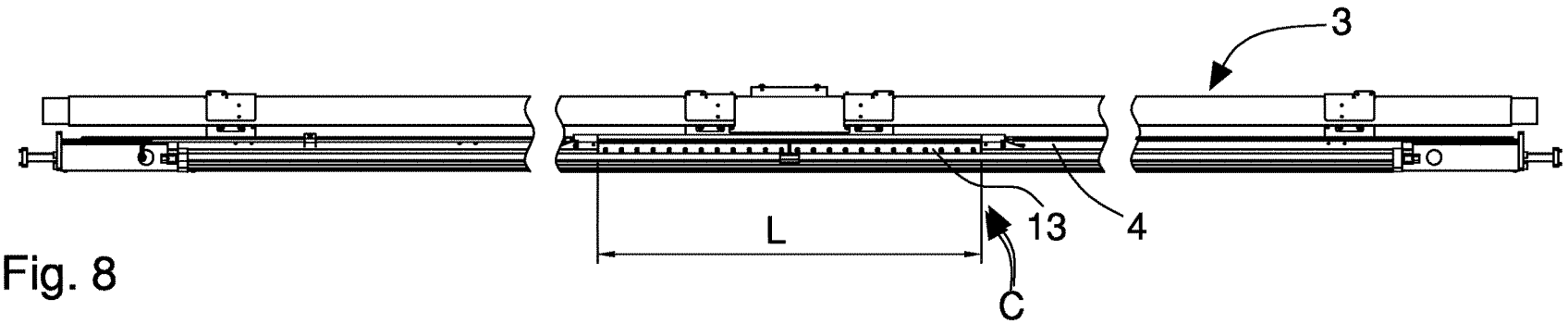
FIG. 8 is a plan bottom view of the punch means of FIG. 7.
Figure 7:
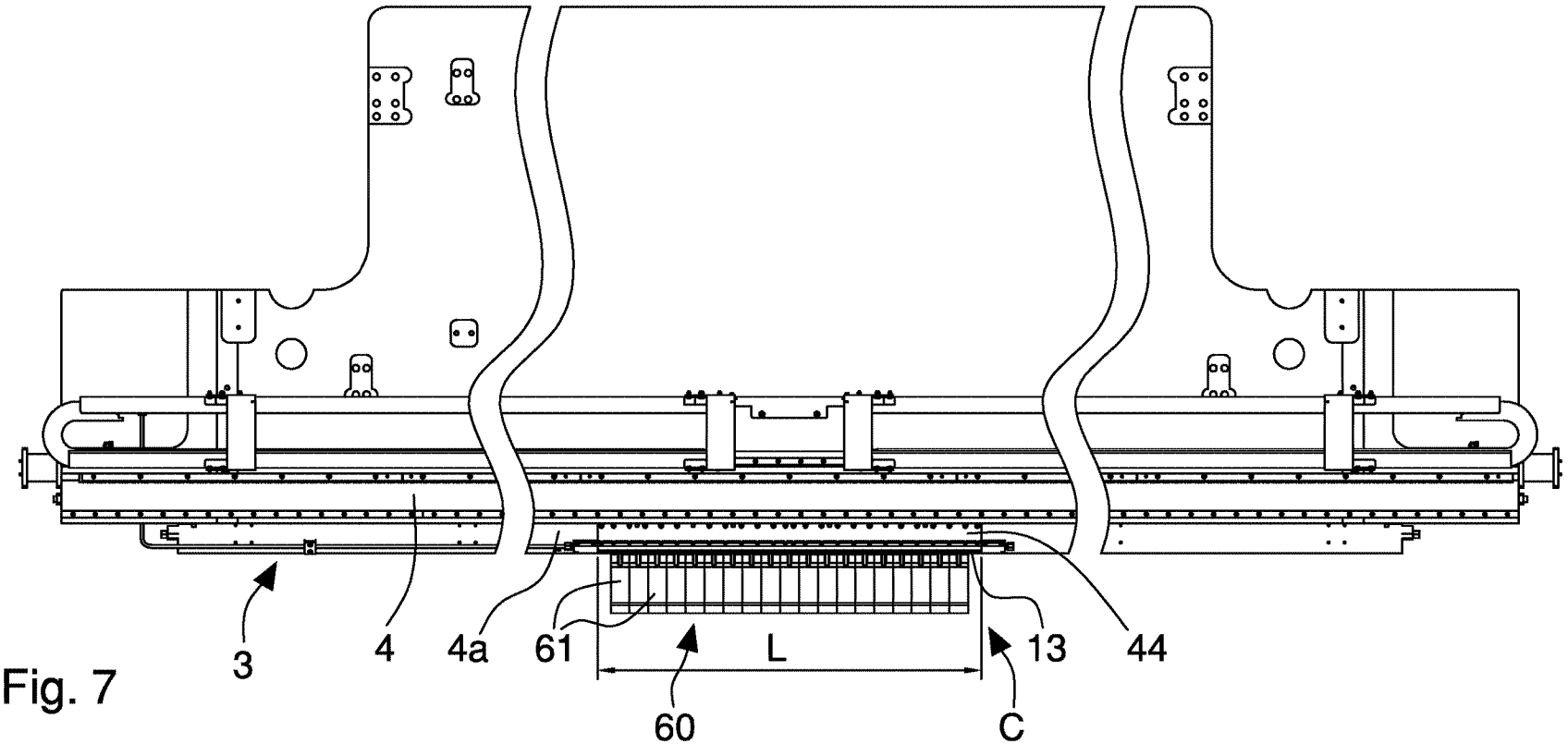
FIG. 7 is an interrupted schematic rear view of the punch means of the bending machine of FIG. 1, illustrating in particular the upper tool-holding crosspiece and a closing element of a guiding groove of said upper tool-holding crosspiece.

As illustrated in FIG. 2, the gripping elements 21, 22 are elements elongated along the bending direction A and having a length substantially corresponding to the length of the lower opening 24*a* of the supporting groove 24 so as to be able to replace (remove or insert) a set 60 of upper bending tools having substantially said length L.

The gripping elements 21, 22 have respective shaped ends 21*a*, 22*a* adapted to fit into the clasping seats 52, 62 of the bending tools of a set 50, 60 of bending tools in a closed insertion configuration and then engage and lock in the clasping seats 52, 62 in the first gripping position P1 to allow gripping and then lifting and transferring the entire set of bending tools 50, 60.

The gripping elements 21, 22 are moved between the closed insertion configuration and the open gripping configuration, i.e. moving away from or closer to each other, by respective actuating means of known type and not illustrated in detail. In particular, the actuating means moves the two gripping elements 21, 22 closer to or away from each other linearly along a direction substantially parallel to the removal/insertion direction V.

The bending machine 1 comprises moving means 30 arranged to support and move the gripping means 21, 22 at least along a first actuating direction X, substantially orthogonal to the bending direction A and parallel to the supporting plane M, and along a second actuating direction Y, substantially orthogonal to the first actuating direction X and to the bending direction A, i.e. parallel to the removal/insertion direction V.

The gripping means 21, 22 and the moving means 30 form a replacement apparatus 20 of the bending machine 1 of the invention, that is positioned inside the inner compartment 7 and is arranged to remove the bending tools 51, 61 from the tool magazine 10 and mount them on the punch means 3 and/or on the die means 5 and vice versa, i.e. to dismount complete set 50, 60 of bending tools 51, 61 from the punch means 3 and the die means 5 and transfer them to the tool magazine 10.

For this purpose, the moving means 30 is further configured to move the gripping means 21, 22 in the inner compartment 7 between the first gripping position P1 and a second gripping position P2. In the first gripping position P1 the gripping means 21, 22 is able to take from, or transfer to, the punch means 3 and/or the die means 5, the set 50, 60 of bending tools; in the second gripping position P2, the gripping means 21, 22 are able to transfer to, or take from the tool magazine 10 a set 50, 60 of bending tools.

The tool magazine 10 is positioned inside the inner compartment 7 and comprises, for example, a plurality of supporting guides 11 that are adapted to house respective sets 50, 60 of lower and upper bending tools and arranged adjacent and parallel to the bending direction A and the supporting plane M. The tool magazine 10 further comprises a transfer carriage 15 movable along the first actuating direction X between an exchanging position S, wherein said transfer carriage 15 is adjacent to the replacement apparatus 20 for receiving from, or giving to, the gripping means 21, 22 a set 50, 60 of bending tools, and a plurality of loading positions L, in each of which the transfer carriage 15 is substantially aligned with a respective supporting guide 11 for transferring to, or receiving from, said supporting guide 11 a set 50, 60 of bending tools.

The tool magazine 10 also comprises at least one tool-holding tray 12 that is arranged to support a plurality of supporting guides 11, which are positioned adjacent to each other and parallel to the bending direction A and the supporting plane M, and is slidably fixed to a base plane 8 of the supporting frame 2 of the bending machine 1. The tool-holding tray 12 is movable along the first actuating direction X between an operating position B1, in which said tool-holding tray is completely inside the bending machine 1, in the inner compartment 7, to enable the supporting guides 11 receiving from, or giving to, the transfer carriage 15 a set 50, 60 of bending tools 51, 61, and a non-operating position B2, in which the tool tray 11 is outside the bending machine 1 and the inner compartment 7 to allow insertion into, or removal from, the supporting guides 11 of sets 50, 60 of bending tools.

The replacement apparatus 20 and the tool magazine 10 inserted in the inner compartment 7 of the bending machine 1 of the invention are described in the Italian patent application no. 102018000009371 filed by the same applicant.

The operation of the bending machine 1 of the invention provides a procedure for disassembling from the punch means 3 a set or series or group 60 of upper bending tools 61 having a defined length L. For this purpose the gripping means 21, 22 are moved by the moving means 30 along the first and second actuating directions X, R so as to clasp all the upper bending tools 61 of the said set 60 of bending tools. More precisely, the shaped ends 21*a*, 22*a* of the gripping elements 21, 22, which are arranged in the closed configuration, first are inserted into the clasping seats 62 of all the upper bending tools 61 of the set 60 and then are engaged and locked in the clasping seats 62 in the first gripping position P1, by moving the gripping elements 21, 22 in the open configuration.

In order to extract or remove from the upper tool-holding crosspiece 4 the entire set 60 of upper bending tools 61 (which are now supported by the gripping means 21, 22), the locking means 40 of the punch means 3 is deactivated so as to unlock the upper bending tools 61 of the set 60 from the guiding groove 14 of the upper tool-holding crosspiece 4. More precisely, the second elastic conduit 25 of the second actuating means is deactivated so that the second elastic means 26 return all the stop elements 41 to the releasing configuration H.

Subsequently or at the same time, the closing element 13 is moved by the first actuating means from the closed position C to the open position D along the opening direction T so as to clear the second lower opening 24*a* of the supporting groove 24. In this way, through the second lower opening 24*a* the supporting pins 65 can exit and disengage from the supporting groove 24 along the removal/insertion direction V and the respective upper bending tools 61 of the set 60 can be extracted or removed from the guiding groove 14.

When the closing element 13 is arranged in the open position D, the gripping means 21, 22 can be moved along the second actuating direction R, parallel to the removal/insertion direction V, so as to remove the entire set 60 of upper bending tools 61 from the upper tool-holding crosspiece 4 and then transfer the set to the tool-holding magazine 10.

The procedure for mounting a set of 60 of upper bending tools 61 provides that the gripping means 21, 22, supporting a set of 60 upper bending tools 61 taken from the tool magazine 10, is moved (in the final step along the second actuating direction R) so as to insert the connecting ends 61*a* of the upper bending tools 61 into the guiding groove 14 through the first lower opening 14*c* and the respective supporting pins 65 into the supporting groove 24 through the second lower opening 24*a* kept open by the closing element 13 arranged in the open position D.

Once the connecting ends 61*a* of the upper bending tools 61 of the set 60 have been completely inserted inside the guiding groove 14, the closing element 13 is moved by the first actuating means in the closed position C so as to close the second lower opening 24*a* and close the supporting pins 65 inside the supporting groove 24 to keep the upper bending tools 61 slidably coupled to the upper tool-holding crosspiece 4.

At this point, the gripping means 21, 22 can release the upper bending tools 61 to allow the bending machine 1 to proceed with the planned bending operations.

Thanks to the bending machine 1 of the invention it is therefore possible to quickly and efficiently replace the bending tools 51, 61 mounted on the punch means 3 and on the die means 5, minimizing the stopping times of the bending machine.

In particular, it is possible to replace in a single operation a complete set 60 of upper bending tools 61 that can be removed from, or inserted into, the upper tool-holding crosspiece 4 of the punch means 3 by the gripping means 21, 22 through the second lower opening 24*a* of the supporting groove 24 to allow the passage of the supporting pins 65 of the upper bending tools 61; the second lower opening 24*a* can be selectively closed by the mobile closing element 13. The length L of the second lower opening 24*a* and of the closing element 13 is equal to the length of the set 60 of bending tools 61 to be mounted.

It should be noted that thanks to this solution it is possible to use on the bending machine 1 of the invention upper bending tools 61 provided with fixed supporting pins 65, which cannot be retracted inside the tool body, i.e. bending tools that are much cheaper and stronger than bending tools having internal means and mechanisms for moving the supporting pin. It should also be noted that the upper tool-holding crosspiece 4 of the punch means 3, which is provided with the closing element 13 selectively movable for closing or opening the second lower opening 24*a* of the supporting groove 24 and with the locking means 40, comprising a plurality of locking elements 41 selectively movable for locking or releasing the upper bending tools 61 to/from the guiding groove 14, has a particularly simple and compact structure, with effective and reliable operation.

The invention claimed is:

1. A bending machine for metal sheets, the bending machine comprising:

a punch assembly including an upper tool-holding crosspiece that is provided with and supports at least one set of upper bending tools provided with respective supporting pins and aligned and reciprocally positionable on said upper tool-holding crosspiece along a bending direction; and a first actuating system, wherein said upper tool-holding crosspiece is provided with a guiding groove that is open at the bottom by a first lower opening for receiving said at least one set of upper bending tools and comprises a lateral supporting groove adapted to receive and support said supporting pins and to maintain said at least one set of upper bending tools slidably coupled to said upper tool-holding crosspiece in an assembly configuration thus preventing disengagement of said upper bending tools, wherein the lateral supporting groove comprises a single second lower opening having a definite length along the bending direction such as to allow disengaging/engaging said supporting pins from/with the lateral supporting groove to remove/insert from/into said upper tool-holding crosspiece at the same time all said upper bending tools of said at least one set of upper bending tools, wherein said punch assembly further includes a single closing element that has the definite length along the bending direction, is connected to said upper tool-holding crosspiece and is linearly movable between a closed position, wherein said single closing element closes the single second lower opening of the lateral supporting groove to keep said supporting pins engaged with, and supported by, the lateral supporting groove, and an open position, wherein said single closing element is spaced from, and does not close, the single second lower opening to disengage said supporting pins, wherein said first actuating system is for linearly moving said single closing element between the closed position and the open position along an opening direction, which is substantially parallel to a supporting plane of said bending machine, and wherein said first actuating system includes at least one first elastic conduit that is feedable with pressurized fluid, is interposed between said single closing element and an internal wall of said upper tool-holding crosspiece and is arranged to expand when fed with the pressurized fluid so as to move said single closing element from the closed position to the open position.

2. The bending machine according to claim 1, wherein the definite length of the single second lower opening and said single closing element is longer than or substantially equal to a length of said at least one set of upper bending tools along the bending direction.

3. The bending machine according to claim 1, wherein the guiding groove extends for an entire length of said upper tool-holding crosspiece.

4. The bending machine according to claim 1, wherein said punch assembly further includes a locking assembly associated with said upper tool-holding crosspiece and selectively activable for locking said upper bending tools to said upper tool-holding crosspiece in order to prevent any movement of said upper bending tools, transverse to, and longitudinal along, the bending direction.

5. The bending machine according to claim 4, wherein said locking assembly comprises a plurality of locking elements, which are movable, housed in said upper tool-holding crosspiece and configured to engage and block in the guiding groove said upper bending tools of at least said at least one set of upper bending tools in a locking configuration so as to prevent any movement thereof.

6. The bending machine according to claim 5, further comprising a second actuating system for linearly moving said locking elements between the locking configuration and a releasing configuration wherein said locking elements do not engage said upper bending tools.

7. The bending machine according to claim 1, wherein each of said upper bending tools of said at least one set of upper bending tools comprises a connecting end arranged to be inserted into the guiding groove and opposite an operating end adapted to interact with a workpiece, a respective one of said supporting pins being fixed to said connecting end and protruding transversely from said connecting end.

8. The bending machine according to claim 1, wherein said at least one set of upper bending tools comprises a predefined number of upper bending tools and is interchangeable with one of a plurality of different sets of upper bending tools.

9. The bending machine according to claim 1, wherein said at least one set of upper bending tools is a plurality of sets of upper bending tools slidably coupled to said upper tool-holding crosspiece in a working configuration of said bending machine, said upper bending tools of said plurality of sets of upper bending tools being reciprocally positionable along the bending direction in order to form definite compositions of bending tools adapted to perform respective machining on workpieces.

10. The bending machine according to claim 1, further comprising a die assembly arranged to interact with said punch assembly for machining a piece.

11. The bending machine according to claim 1, further comprising a gripping device configured to clasp and remove/insert from/into the guiding groove simultaneously all of said upper bending tools of said at least one set of upper bending tools.

12. The bending machine according to claim 11, wherein each of said upper bending tools of said at least one set of upper bending tools comprises a respective clasping seat, and said gripping device comprises a pair of gripping elements movable and arranged to engage and lock in a first gripping position said clasping seats of all of said upper bending tools of said at least one set of upper bending tools.

13. The bending machine according to claim 1, wherein said at least one set of upper bending tools comprises a predefined number of upper bending tools and is interchangeable with one of a plurality of different sets of upper bending tools, said plurality of different sets of upper bending tools being housed in a tool magazine of said bending machine.

14. The bending machine according to claim 1, wherein said at least one set of upper bending tools is a plurality of sets of upper bending tools slidably coupled to said upper tool-holding crosspiece in a working configuration of said bending machine, said upper bending tools of said plurality of sets of upper bending tools being reciprocally positionable along the bending direction in order to form definite compositions of bending tools adapted to perform respective machining on workpieces, said plurality of sets of upper bending tools being interchangeable.

15. The bending machine according to claim 1, further comprising:

a die assembly arranged to interact with said punch assembly for machining a piece; and a plurality of lower bending tools that are couplable to a lower tool-holding crosspiece of said die assembly, aligned and positionable along the bending direction.

* * * * *